US005511946A

United States Patent [19]

Lee et al.

[11] Patent Number: 5,511,946

[45] Date of Patent: Apr. 30, 1996

[54] COOLED AIRFOIL TIP CORNER

[75] Inventors: Ching-Pang Lee, Cincinnati, Ohio; Gary E. Wheat, Madisonville; Barry T. Malone, Dawson Springs, both of Ky.; Nicholas C. Palmer, Loveland; Robert C. Simmons, Cincinnati, both of Ohio

[73] Assignee: General Electric Company, Cincinnati, Ohio

[21] Appl. No.: 361,242

[22] Filed: Dec. 8, 1994

[51] Int. Cl.[6] ..... F01D 5/18

[52] U.S. Cl. ..... 416/97 R

[58] Field of Search ..... 416/95, 97 R, 416/97 A; 415/115

[56] References Cited

U.S. PATENT DOCUMENTS

| | | | |
|---|---|---|---|
| 3,329,596 | 7/1967 | Abt et al. | 416/97 R |
| 3,934,322 | 1/1976 | Hauser et al. | 416/97 R |
| 4,183,716 | 1/1980 | Takahara et al. | 416/96 A |
| 4,752,186 | 6/1988 | Liang | 416/97 R |
| 4,753,575 | 6/1988 | Levengood et al. | 415/115 |
| 4,940,388 | 7/1990 | Lilleker et al. | 416/96 R |
| 5,125,798 | 6/1992 | Muth et al. | 416/97 R |
| 5,246,340 | 9/1993 | Winstanley et al. | 416/97 R |
| 5,370,499 | 12/1994 | Lee | 416/97 R |
| 5,403,159 | 4/1995 | Green et al. | 416/97 R |

*Primary Examiner*—Edward K. Look
*Assistant Examiner*—James A. Larson
*Attorney, Agent, or Firm*—Andrew C. Hess; Patrick R. Scanlon

[57] ABSTRACT

A gas turbine engine airfoil includes a tip corner disposed at the juncture of the airfoil tip and trailing edge, and a cooling hole extends therethrough in direct flow communication with an internal cooling passage thereof. A cross-hole extends perpendicularly into the tip corner and into the cooling hole for discharging from the airfoil a portion of cooling air channeled into the cooling hole. The airfoil tip corner is therefore cooled by the air channeled through the cross-hole received from the intersecting cooling hole.

8 Claims, 1 Drawing Sheet

COOLED AIRFOIL TIP CORNER

The present invention relates generally to gas turbine engine rotor blades, and, more specifically, to cooling of turbine blade tips.

BACKGROUND OF THE INVENTION

Typical turbine rotor blades in a gas turbine engine are hollow and include one or more cooling circuits therein through which is circulated cooling air bled from a compressor of the engine. The art of cooling turbine blades is very crowded and includes various holes and turbulators for cooling the various portions of the airfoil.

The airfoil portion of a typical blade has pressure and suction sides joined together at leading and trailing edges and extend from a root to tip of the airfoil. During operation, hot combustion gases flow over the airfoil from the combustor of the engine, with the airfoil extracting energy therefrom for powering a rotor disk to which it is attached. The surface of the airfoil experiences varying heat input at different locations thereof, and therefore various cooling arrangements are tailored to the airfoil for suitably cooling the various portions thereof.

In a typical configuration, the airfoil includes a cooling air passage extending radially along its trailing edge, with the trailing edge having a plurality of radially spaced apart axial cooling holes which cool the airfoil trailing edge. The airfoil tip also may include radially extending cooling holes therethrough for cooling thereof. However, the intersection between the airfoil trailing edge and the airfoil tips defines a tip corner which also typically requires cooling thereof. In one conventional configuration, cooling holes radiate outwardly through the tip corner in a fan configuration from the axial, trailing edge cooling holes to the radial, tip cooling holes for effectively cooling the tip corner.

The various cooling holes in the airfoil are formed or drilled using conventional processes such as laser drilling and electrical discharge machining (EDM) which are effective for forming the relatively small diameters required. However, these processes limit the length or depth of the cooling holes which may be formed therewith. Since the fan shaped cooling holes through the airfoil tip Corner are significantly longer than the adjacent cooling holes in the trailing edge and airfoil tip, they require a different process for forming their longer lengths.

For example, conventional electrostream (ES) drilling may be used for forming the fan shaped cooling holes through the airfoil tip corner. Electrostream drilling uses a suitable electrolytic liquid and electricity to drill the cooling holes using an electrochemical reaction in a conventionally known process. In that process, glass nozzles are used for directing the electrolyte flow against the airfoil for drilling the required cooling holes therethrough. However, in order to form the fan shaped cooling holes in the airfoil tip corner, the electrostream glass nozzles must be inclined relative to the outer surface of the tip corner at angles substantially less than 90° or normal thereto which results in substantial breakage of the glass nozzles during the drilling process, with an attendant increase in manufacturing costs, which is undesirable.

SUMMARY OF THE INVENTION

A gas turbine engine airfoil includes a tip corner disposed at the juncture of the airfoil tip and trailing edge, and a cooling hole extends therethrough in direct flow communication with an internal cooling passage thereof. A cross-hole extends perpendicularly into the tip corner and into the cooling hole for discharging from the airfoil a portion of cooling air channeled into the cooling hole. The airfoil tip corner is therefore cooled by the air channeled through the cross-hole received from the intersecting cooling hole.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
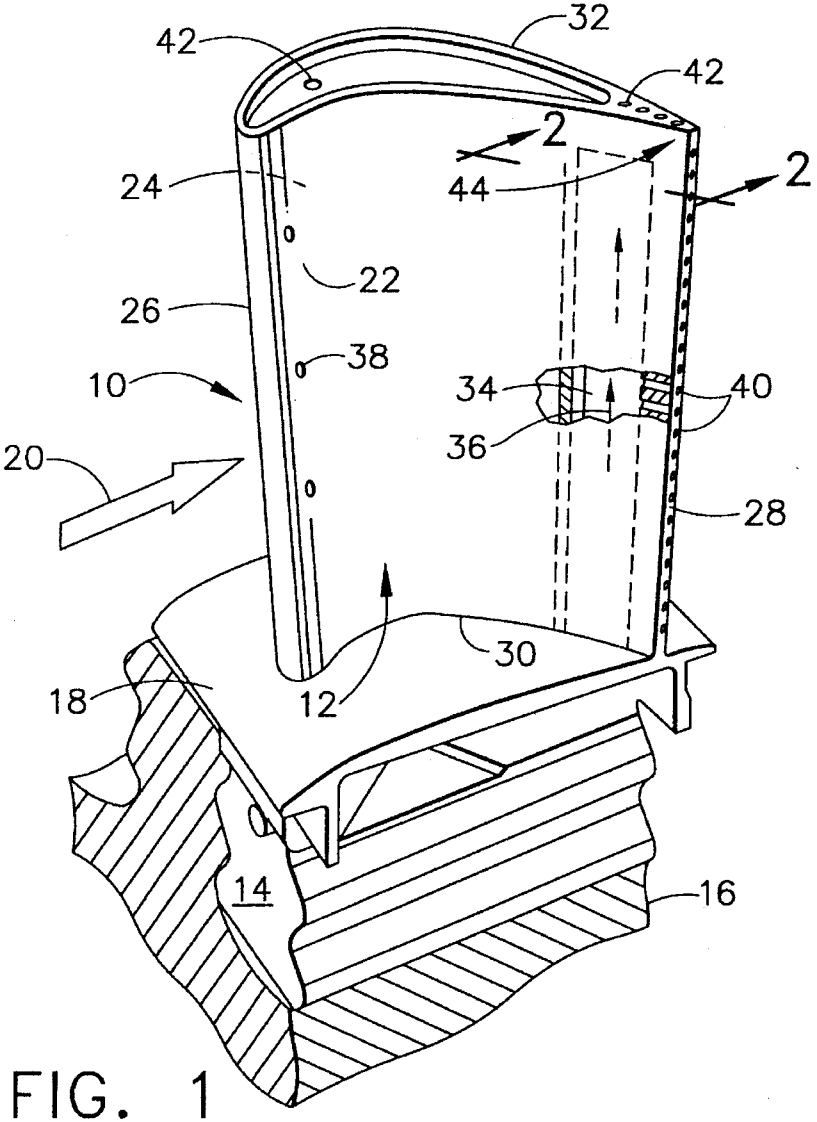
FIG. 1 is a perspective, partly sectional view of an exemplary gas turbine engine turbine rotor blade joined to a rotor disk and having an airfoil with a tip corner including cooling passages in accordance with one embodiment of the present invention.

Illustrated in FIG. 1 is an exemplary gas turbine engine turbine rotor blade 10. The blade 10 includes a hollow airfoil 12 and an integral, axial entry dovetail 14 which conventionally mounts the blade 10 in a complementary dovetail slot in an annular rotor disk 16. An integral platform 18 separates the airfoil 12 from the dovetail 14 and provides a radially inner boundary for combustion gases 20 which flow over the airfoil 12 which extracts energy therefrom for rotating the disk 16 during operation.

The airfoil 12 includes a first or pressure side 22 which is generally concave, and an opposite, second r suction side 24 which is generally convex. The first and second sides 22, 24 are joined together at axially spaced apart leading and trailing edges 26 and 28 and extend longitudinally or radially from an airfoil root 30 at the platform 18 to a radially outer tip 32.

In order to cool the airfoil 12 during operation, the airfoil 12 includes one or more conventional internal cooling passages or circuits 34 for channeling cooling air 36 which is conventionally bled from a compressor of the gas turbine engine (not shown). The airfoil 12 includes various conventional components for the cooling thereof such as film cooling holes 38 near the leading edge 26 of the airfoil 12, trailing edge cooling holes 40 extending axially through the trailing edge 28, and tip cooling holes 42 extending radially outwardly through the airfoil tip 32.

Figure 2:
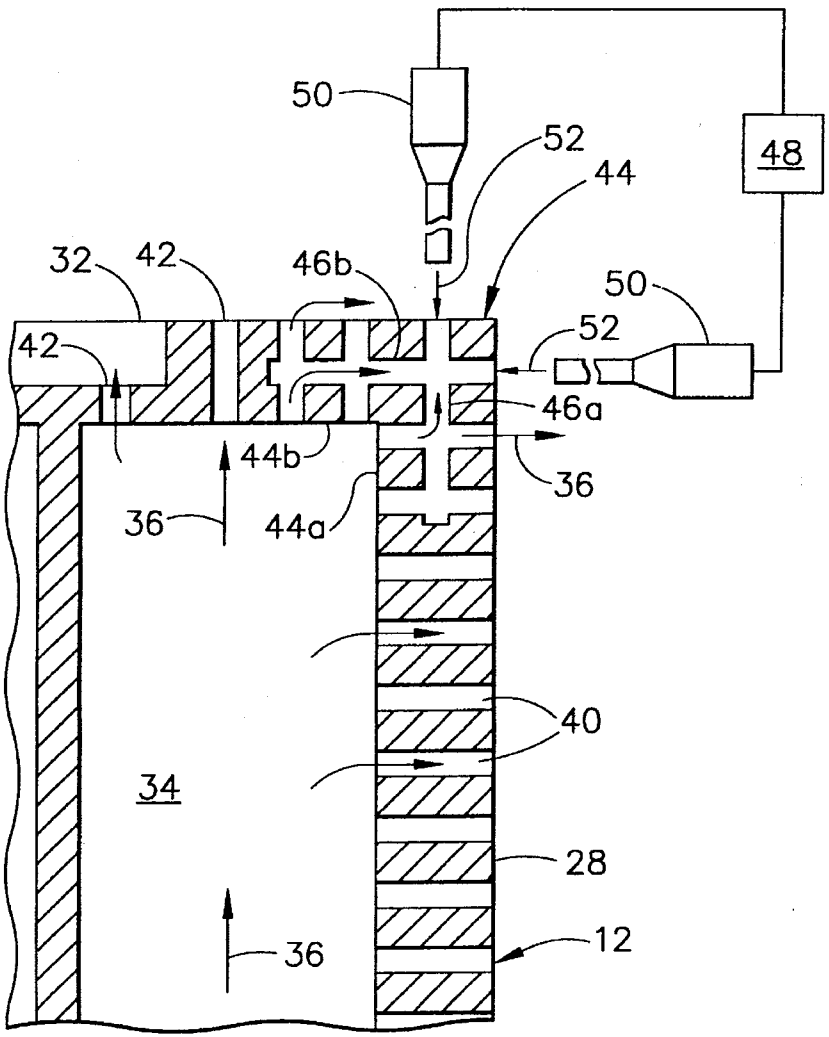
FIG. 2 is an enlarged sectional view of the airfoil tip corner illustrated in FIG. 1 and taken along line 2—2 showing the cooling passages thereof and a schematic representation of electrostream drilling thereof.

Disposed at the juncture of the airfoil tip 32 and the airfoil trailing edge 28 is an airfoil tip corner 44 having a cooling arrangement in accordance with one embodiment of the present invention which is illustrated in more particularity in FIG. 2. More specifically, the tip corner 44 illustrated in FIG. 2 is generally L-shaped and includes a radial leg **44*a* extending longitudinally or radially inwardly along the airfoil trailing edge 28 at the airfoil tip 32, and a complementary axial or tip leg 44*b* extending axially upstream along the airfoil tip 32 at the airfoil trailing edge 28 which is generally perpendicular to the radial leg 44*a***.

The tip corner 44 is cooled in part by the radially top most ones of the trailing edge, or first, cooling holes 40 disposed in the tip corner radial leg **44*a*, and also in part by the aft most ones of the tip, or second, cooling holes 42 disposed in the tip leg 44***b*.

The trailing edge holes 40 and the tip cooling holes 42 are in direct flow communication with the cooling passage 34 for receiving therefrom portions of the cooling air 36 which is channeled therethrough and discharged from the airfoil 12. In order to cool the remainder of the tip corner 44, at least one, or first, cross-hole 46*a* extends radially downwardly through the tip corner 44 and through the radial leg 44*a* and into one or more of the axial trailing edge cooling holes 40 for discharging from the airfoil 12 a portion of the cooling air 36 firstly channeled into the cooling hole 40 in an indirect flowpath from the cooling passage 34. As shown in FIG. 2, the first cross-hole 46*a* preferably extends through at least two of the trailing edge cooling holes 40 disposed in the tip corner radial leg 44*a*, with each of the two intersecting holes 40 providing respective portions of the cooling air 36 to feed the first cross-hole 46*a*. The number of intersections between the first cross-hole 46*a* and the adjoining trailing edge cooling holes 40 is determined far each design application for ensuring sufficient flow of the cooling air 36 through the first cross-hole 46*a* for providing effective cooling of the tip corner 44.

Similarly, a second cross-hole 46*b* may also be used if desired and extends axially through the tip leg 44*b* of the tip corner 44 to one or more of the adjoining radial tip cooling holes 42 for receiving a portion of the cooling air 36 therefrom.

By using the first or second cross-holes 46*a,b*, or both, effective cooling of the airfoil tip corner 44 may be obtained, while also allowing the cross-holes 46*a,b* to be formed using conventional electrostream (ES) drilling without concern for glass nozzle breakage due to off-normal drilling such as that used for drilling the fan shaped tip holes disclosed above.

More specifically, a conventional electrostream drilling system 48 includes a glass nozzle 50 through i which is ejected a suitable electrolytic fluid jet 52 for forming the first or second cross-holes 46*a,b* through the tip corner 44. As shown in FIG. 2, the nozzle 50 is preferably disposed perpendicularly to the airfoil trailing edge 28 to form the second cross-hole 46*b*, and may also be positioned perpendicularly to the airfoil tip 32 for forming the first cross-hole 46*a*. Since the glass nozzle 50 may be oriented perpendicularly to the tip corner 44, breakage thereof due to off-normal orientation is no longer a concern and therefore improves the drilling process.

Accordingly, both the first and second cross-holes 46*a,b* may extend perpendicularly through their respective sides of the tip corner 44, with the first cross-hole 46*a* being perpendicular to the airfoil tip 32, and the second cross-hole 46*b* being perpendicular to the airfoil trailing edge 28. The trailing edge cooling holes 40 are preferably also conventionally formed perpendicularly to the trailing edge 28, with the tip cooling holes 42 being preferably formed perpendicularly to the airfoil tip 32. In this way, the first cross-hole 46*a* intersects the adjoining trailing edge cooling holes 40 perpendicularly thereto, and the second cross-hole 46*b* intersects the adjoining tip cooling holes 42 perpendicularly thereto.

In the exemplary embodiment illustrated in FIG. 2, single ones of the first and second cross-holes 46*a,b* extend through the middle of their respective radial and tip legs 44*a,b*, although in alternate embodiments, more than one of the first and second cross-holes 46*a,b* may be used if desired. Also in the exemplary embodiment illustrated in FIG. 2, the first and second cross-holes 46*a,b* intersect each other inside the tip corner 44 which further ensures cross-flow of the cooling air 36 through the cross-holes 46*a,b*.

Since the intersecting first and second cross-holes 46*a,b* may be drilled perpendicularly to the tip corner 44, the breakage of electrostream glass nozzles 50 will be significantly reduced. Furthermore, the processing setup to drill these intersecting cross-holes 46*a,b* may be integrated with the respective setups for drilling the several trailing edge holes 40 and the several tip cooling holes 42 for improving the overall manufacturing process. Yet further, the flow turbulence generated inside the intersecting cross-holes 46*a,b* themselves and their intersection with the respective trailing edge cooling holes 40 and tip cooling holes 42 will be higher than that found in conventional non-intersecting straight passages for improving heat transfer and more effectively cooling the blade tip corner 44.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

We claim:

1. A gas turbine engine airfoil comprising:

first and second opposite sides joined together at spaced apart leading and trailing edges and extending from a root to a tip;

an internal cooling passage for channeling cooling air therethrough; and a tip corner disposed at a juncture of said airfoil tip and said airfoil trailing edge, and having a plurality of cooling holes extending therethrough in direct flow communication with said cooling passage for discharging said cooling air from said airfoil, and further having a cross-hole extending perpendicularly into said corner and into at least one of said cooling holes for discharging from said airfoil a portion of said cooling air channeled into said at least one cooling hole.

2. An airfoil according to claim 1 wherein said cross-hole extends into at least two of said cooling holes for receiving air therefrom.

3. An airfoil according to claim 1 wherein:

said tip corner includes a radial leg extending along said airfoil trailing edge at said airfoil tip, and a tip leg extending along said airfoil tip at said airfoil trailing edge and generally perpendicular to said radial leg; and said at least one cooling hole extends through one of said radial leg and said tip leg, with said cross-hole extending perpendicularly thereto.

4. An airfoil according to claim 3 wherein said at least one cooling hole extends through said radial leg perpendicularly to said trailing edge, and said cross-hole extends through said tip corner to said at least one cooling hole and perpendicularly to said airfoil tip.

5. An airfoil according to claim 3 wherein said at least one cooling hole extends through said tip leg perpendicularly to said airfoil tip, and said cross-hole extends through said tip corner to said at least one cooling hole and perpendicularly to said airfoil trailing edge.

6. A gas turbine engine airfoil comprising:

first and second opposite sides joined together at spaced apart leading and trailing edges and extending from a root to a tip;

an internal cooling passage for channeling cooling air therethrough;

a tip corner disposed at a juncture of said airfoil tip and said airfoil trailing edge, said tip corner including a radial leg extending along said airfoil trailing edge at said airfoil tip, and a tip leg extending along said airfoil tip at said airfoil trailing edge and generally perpendicular to said radial leg;

a first cooling hole extending through said radial leg perpendicularly to said trailing edge in direct flow communication with said cooling passage for discharging said cooling air from said airfoil, and a first cross hole extending through said tip corner to said first cooling hole and perpendicularly to said airfoil tip for discharging from said airfoil a portion of said cooling air channeled into first cooling hole; and a second cooling hole extending through said tip leg perpendicularly to said airfoil tip in direct flow communication with said cooling passage for discharging said cooling air from said airfoil, and a second cross hole extending through said tip corner to said second cooling hole and perpendicularly to said airfoil trailing edge for discharging from said airfoil a portion of said cooling air channeled into second cooling hole.

7. An airfoil according to claim 6 wherein said first and second cross-holes perpendicularly intersect each other in said tip corner.

8. An airfoil according to claim 7 further comprising:

a plurality of said first cooling holes disposed in said tip corner radial leg; and a plurality of said second cooling holes disposed in said tip leg; and said first cross-hole extends into said plurality of first cooling holes; and said second cross-hole extends into said plurality of second cooling holes.

* * * * *